US009823683B2

(12) United States Patent
Livolsi

(10) Patent No.: US 9,823,683 B2
(45) Date of Patent: Nov. 21, 2017

(54) FIXED ADJUSTMENT DIAL

(71) Applicant: Anthony L. Livolsi, Davie, FL (US)

(72) Inventor: Anthony L. Livolsi, Davie, FL (US)

( * ) Notice: Subject to any disclaimer, the term of this patent is extended or adjusted under 35 U.S.C. 154(b) by 154 days.

(21) Appl. No.: 13/973,393

(22) Filed: Aug. 22, 2013

(65) Prior Publication Data

US 2015/0053043 A1 Feb. 26, 2015

(51) Int. Cl.

| | |
|---|---|
| ***G05G 1/12*** | (2006.01) |
| ***G05G 1/08*** | (2006.01) |
| ***G05G 5/00*** | (2006.01) |

(52) U.S. Cl.

CPC ..... *G05G 1/12* (2013.01); *G05G 1/08* (2013.01); *G05G 5/005* (2013.01); *Y10T 74/2084* (2015.01)

(58) Field of Classification Search

CPC ..... G05G 1/06; G05G 1/082; G05G 1/08; G05G 1/12; G05G 5/005; F16H 59/0278; F42C 19/00; Y10T 16/506; Y10T 16/063; A47L 15/4293; D06F 39/005; F24C 7/082

USPC ..... 74/553, 548; 16/412, 422; 403/372; 192/69.7

See application file for complete search history.

(56) References Cited

U.S. PATENT DOCUMENTS 2,509,058 A * 5/1950 Haury ..... G05G 1/10 338/162
2,660,904 A * 12/1953 Hilsinger, Jr. ..... G05G 5/26 200/330
2,742,127 A 4/1956 Mumford et al.
2,780,333 A * 2/1957 Hyman et al. ..... 192/69.7
2,797,592 A * 7/1957 Marrapese ..... G05G 1/10 192/66.32
2,899,841 A 8/1959 Melloy
3,100,404 A 8/1963 Boeddeker et al.
3,187,287 A 6/1965 Weidenman
3,198,923 A * 8/1965 Tripp ..... G05G 1/10 116/318

(Continued)

OTHER PUBLICATIONS

U.S. Patent and Trademark Office; Office Action dated Mar. 16, 2016, as entered in related U.S. Appl. No. 29/531,249 (7 pages).

(Continued)

*Primary Examiner* — Vinh Luong

(74) *Attorney, Agent, or Firm* — Keven P. Crosby; GrayRobinson, P.A.

(57) ABSTRACT

A mechanism to prevent an adjustment knob associated with a piece of equipment (e.g. musical instrument or amplifier) from being moved accidentally includes an inner hub held in place on an adjustable shaft. An knob body fits concentrically over the inner hub, and is biased into position over the hub. The bottom of the knob body has locking structure which lockingly but releasingly cooperates with locking structure associated with the piece of equipment to which the shaft is affixed. A biasing structure such as a spring retains the knob body in a first, locked, position, in which the knob body is prevented from rotating, which in turn prevents rotation of the adjustable shaft. However, when the knob body is pulled away from the locking structure against the spring force, the knob body can be rotated, which in turn rotates the hub and shaft shaft. Releasing the knob body allows the biasing structure to urge the knob body back into engagement with the locking structure.

10 Claims, 8 Drawing Sheets

(56) References Cited

U.S. PATENT DOCUMENTS

| | | | | | |
|---|---|---|---|---|---|
| 3,430,515 | A | * | 3/1969 | Lawrence, Jr. | G05G 1/08 74/527 |
| 3,767,880 | A | | 10/1973 | Austin | |
| 3,986,409 | A | * | 10/1976 | Tripp | G05G 1/02 188/83 |
| 3,994,608 | A | * | 11/1976 | Swiderski et al. | 403/372 |
| 4,026,397 | A | | 5/1977 | Raus | |
| 4,036,079 | A | * | 7/1977 | Pratt | G05G 1/10 74/531 |
| 4,084,675 | A | * | 4/1978 | Smith | F16D 11/14 192/69.8 |
| 4,131,033 | A | | 12/1978 | Wright et al. | |
| 4,132,129 | A | * | 1/1979 | Pratt | H01C 10/14 16/441 |
| 4,154,125 | A | | 5/1979 | Frank | |
| D253,289 | S | | 10/1979 | Kato | |
| 4,237,746 | A | * | 12/1980 | Rossi | F16B 17/006 29/512 |
| 4,347,758 | A | | 9/1982 | Geil et al. | |
| 4,549,716 | A | * | 10/1985 | Warren | F16K 31/60 192/69.91 |
| 4,691,895 | A | * | 9/1987 | Garff | F16K 35/02 251/292 |
| 4,733,035 | A | | 3/1988 | Ohashi | |
| 4,779,305 | A | | 10/1988 | Gorsek | |
| 5,048,365 | A | * | 9/1991 | Webb | 74/553 |
| 5,144,718 | A | * | 9/1992 | Ozawa | 16/412 |
| 5,152,187 | A | | 10/1992 | LaFemina | |
| 5,513,831 | A | | 5/1996 | Seward | |
| 6,041,868 | A | | 3/2000 | Matus et al. | |
| D444,695 | S | | 7/2001 | Decosse | |
| 6,696,915 | B2 | | 2/2004 | Pan | |
| D525,517 | S | | 7/2006 | Baldwin | |
| 7,267,027 | B2 | * | 9/2007 | Bertani | 74/553 |
| D568,715 | S | | 5/2008 | Gustafson et al. | |
| D569,219 | S | | 5/2008 | Sjogren | |
| 7,642,673 | B2 | * | 1/2010 | Baier | F24C 7/082 307/104 |
| 8,079,287 | B2 | * | 12/2011 | Castillo | 74/553 |
| D654,345 | S | | 2/2012 | McCune et al. | |
| 8,733,204 | B2 | | 5/2014 | Voss | |
| 8,832,905 | B2 | * | 9/2014 | Huang | 16/422 |
| D726,159 | S | | 4/2015 | Swendseid et al. | |
| 2014/0021024 | A1 | * | 1/2014 | Heimann | G05G 5/065 200/4 |
| 2014/0047943 | A1 | | 2/2014 | Camli et al. | |

OTHER PUBLICATIONS

Amendment and Response dated Jul. 18, 2016, as filed in related U.S. Appl. No. 29/531,249 (6 pages).

U.S. Patent and Trademark Office; Office Action dated Mar. 10, 2016, as entered in related U.S. Appl. No. 29/531,248 (5 pages).

Amendment and Response dated Jul. 18, 2016, as filed in related U.S. Appl. No. 29/531,248 (3 pages).

* cited by examiner

FIXED ADJUSTMENT DIAL

BACKGROUND OF THE INVENTION

1. Field of the Invention

This invention relates to control mechanisms having angularly adjustable shafts, and, more particularly, relates to devices which permit adjustment of an adjustable control mechanism only upon disengagement of a locking structure associated with the device.

2. Description of the Prior Art

There are many different types of control mechanisms having angularly adjustable output shafts. One such mechanism is the well-known potentiometer. A potentiometer is a variable resistor or rheostat. Potentiometers are commonly used to control electrical devices, such as volume and other controls on audio equipment. Potentiometers comprise a resistive element, a sliding contact (wiper) that moves along the element, making electrical contacts with one part of it, electrical terminals, a housing containing the element and wiper, and an output shaft with which the wiper can be moved from one end of the element to the other. Potentiometer output shafts come in all different configurations, e.g. splined, D-shaped cross-section, hexagonal, or any other polygonal shape.

In many, if not most, potentiometers applications, the angular position of the output shaft is manually set by a user. The user wishes for the angular position of the output shaft to remain in a desired position, so that he or she will not have to re-set that position each time the piece of the equipment that the potentiometer controls is moved, as the perfected settings for such knobs typically takes a long time to achieve.

Potentiometers on consumer audio equipment employ knobs to make it easier to adjust the setting of the potentiometer, to allow for indicia or other markings to be used to indicate setting levels and to provide an esthetic element.

In the case of audio equipment, potentiometers are widely used to adjust the level of analog signals present in the various electronic circuits in the device. As but one example, musicians experience significant disruptions and inconveniences when potentiometer knobs are accidentally bumped during transportation of audio equipment, requiring re-setting and/or re-calibration of the equipment each time it is used.

Control knobs which are normally out of engagement with the output shaft of the mechanism to be adjusted have been proposed. Such knobs exert a manual force on the knob to cause the knob to engage some apparatus to affect turning of the shaft. Such an arrangement would not only be cumbersome to use with consumer audio equipment, but is still susceptible of inadvertent mis-adjustment from accidental bumping, because bumping into such a device exerts a force on the knob, which could cause the locking mechanism to engage and change the adjustment of the output shaft.

Some minimal efforts have been directed in the past to address the problem inherent in adjustable potentiometer output shafts/knobs, namely that they are easily knocked out of adjustment by incidental contact, and the inconvenience and frustration resulting therefrom. For example, U.S. Pat. No. 2,899,844 to Melloy discloses a controlled knob for an adjustable kitchen timer adapted to prevent rotation of the output shaft of the timer in one direction so as to avoid damage to the timer. Melloy discloses a cooperating locking element which only prevent rotation of the knob in one direction, such that inadvertent rotation of the knob can occur in the opposite direction.

The following patents disclose control knobs which when pushed down upon, permit rotation of the potentiometer output shaft and are, for various reasons, undesirable solutions to the problem discussed above; U.S. Pat. No. 4,779,305 to Gorsek; U.S. Pat. No. 5,513,831 to Seward and U.S. Pat. No. 6,696,915 to Pan.

Another type of locking knob is disclosed in U.S. Pat. No. 5,152,187 to LaFemina, which comprises a knob slightably disposed on a splined output shaft and movable between a first, locked position in which corresponding locking elements on the underside of the knob and connected to the potentiometer and/or housing are lockingly engaged, and a second, adjustment, position in which the locking members are disengaged from each other, such that the knob and output shaft can be annularly adjusted. However, the knob of LaFemina is not retained relative to the output shaft while in the second position, such that it can easily be slid off of the output shaft.

SUMMARY OF THE INVENTION

The invention is directed to an inventive knob which is adapted to retain a standard rotatable shaft of a control device such as a potentiometer (or other component) in a normally-non-adjustable position to avoid accidental or otherwise unwanted movement of the shaft. The invention is comprised of an inner hub which is adapted to be placed on the shaft and held in place thereon (e.g. by a set screw). An outer knob body fits concentrically over the inner hub, and defines an inner volume which defines a lower inner shoulder. A compression spring is concentrically disposed about an upper portion of the hub. A lower end of the spring abuts the inner shoulder of the knob body, and an upper end of the spring abuts a bottom surface of an enlarged head portion of the hub. The bottom of the knob body has locking structure which lockingly but releasingly cooperates with corresponding locking structure associated with the piece of equipment (e.g. amplifier) to which the control device is affixed. The spring retains the knob body in a first, locked, position, in which the knob body is prevented from rotating, which in turn prevents rotation of the hub and shaft. However, when the knob body is pulled out away from the locking structure against the spring force, the knob body can be rotated, which in turn rotates the hub and shaft. Releasing the knob body allows the spring to urge the knob body back into the first position where the locking structure is engaged. Means associated with the knob body mates with corresponding means associated with the hub for preventing relative rotation of the knob body and hub, but while permitting axial movement therebetween.

DETAILED DESCRIPTION OF EXEMPLARY EMBODIMENT(S)

Figure 1:
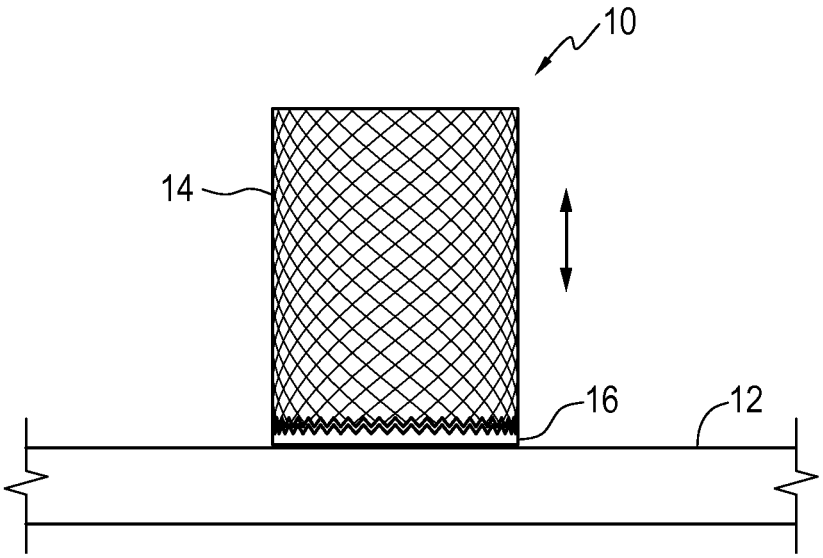
FIG. 1 is an elevational view of a first embodiment of the invention in the locked position associated with a housing.
Figure 2:
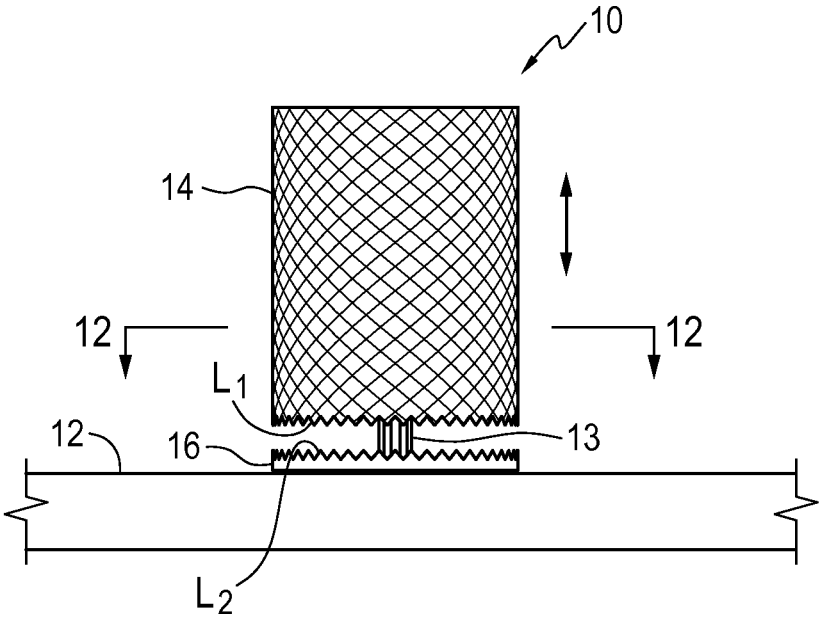
FIG. 2 is a perspective view of the first embodiment of the invention in an unlocked, adjustable, position.

FIGS. 1-12 show a first embodiment of the invention. It is to be understood, however, throughout this disclosure that the various individual components have been depicted in a form which is easily represented and understood for the sake of understanding of the invention. It is to be appreciated, however, that the shape of the individual components may be modified from the forms shown herein without departing from the spirit and scope of the invention.

In addition, the structures shown herein are described in use with the adjustment shaft of a control device, such as a typical adjustable potentiometer. However, it is to be understood that the inventions disclosed herein are suitable for use with any adjustable rotary control member such as the type having a rotary output shaft mounted or extending through a panel of an object, such as, but not by way of limitation, a body of a musical instrument, amplifier or other audio control component.

FIGS. 1-12 depict a first embodiment of the invention herein. With particular reference to FIGS. 1-4, a control knob indicated by reference numeral 10 is releasably held relative to the output shaft 13 of a control device 17, and also lockingly but releasably engaged against an object 12, such as a panel of an audio component or musical instrument containing the control device 17. The knob is shown in a first, locked, position in FIGS. 1 and 4, and in a second, unlocked, position in FIG. 2. The knob is placed into the unlocked position (shown in FIG. 2) by pulling upwardly on outer barrel or knob body 14, which causes locking elements $L_1$ (i.e. a first locking member) associated with at least a portion of a bottom surface of knob body 14 to be removed from engagement with corresponding locking elements $L_2$ (i.e., a second locking member) associated with a locking member 16. Locking member 16 is, in turn, rigidly attached to object 12 or control device 17. When locking elements $L_1$ and $L_2$ are disengaged, knob body 14 can be rotated, which in turn allows for rotation of shaft 13, and commensurate adjustment of control device 17, in a manner which will be described hereinafter.

Figure 16A:
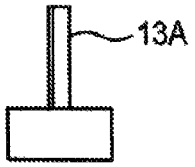
FIG. 16A PRIOR ART
FIG. 16A is a cross-sectional elevational view of a representative prior art potentiometer and first output shaft (D-shaft) type.
Figure 16B:
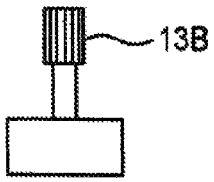
FIG. 16B PRIOR ART
FIG. 16B is a representative prior art potentiometer with a second type of output shaft (splined).
Figure 16C:
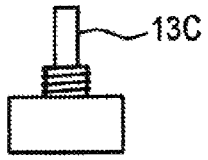
FIG. 16C PRIOR ART
FIG. 16C is a representative prior art potentiometer with a third type of output shaft (threaded).

It is to be appreciated that shaft 13, as well as control device 17, may be of any type or arrangement. FIGS. 16A-C depict known control device adjustment shaft structures. FIG. 16A shows control device 17 having an adjustment shaft 13A with a D-shaped cross-section. FIG. 16B shows a control device 17 having an adjustment shaft 13B with a splined surface. FIG. 16C shows a control device 17 having a shaft 13C with a threaded collar 40 positioned concentrically thereabout onto which locking member 16 may be threaded (in a version where the interior aperture in locking member 16 is threaded). It is to be understood that collar 40 may be employed with any of the control devices depicted herein, including those in FIGS. 16A-C. Alternatively, or in addition, locking member 16 may be connected to object 12 by any known means, such as any set screw or other mechanical fastener(s) such as adhesive.

In a preferred embodiment, knob 10 is arranged as follows: outer knob body or barrel 14 is concentrically disposed about inner hub 20, which in turn is concentrically disposed about adjustment shaft 13. A fastening member, such as a set screw 26, passed through radial bore 26' or any other fastening means is used to lock hub 20 in a given position relative to adjustment shaft 13, and to thus retain knob 10 in position. Hub 20 defines an inner journal 25 which may, but need not necessarily, have a surface contour corresponding to the surface contour of adjustment shaft 13. As discussed previously, the surface contour of adjustment shaft 13 may be cylindrical, splined, hexagonal, D-shaped, or any other shape. All that is required, in the preferred embodiment, is that adjustment shaft 13 have a polygonal surface which substantially matches that of the surface contour of journal 25 of hub 20. By "polygonal surface" is meant a surface that is not cylindrical. However, it is to be appreciated that output shaft may be cylindrical, and journal 25 may also be cylindrical, so long as set screw 26 or other fastener serves the function of preventing angular movement of hub 20 relative to output shaft 13.

Figure 4:
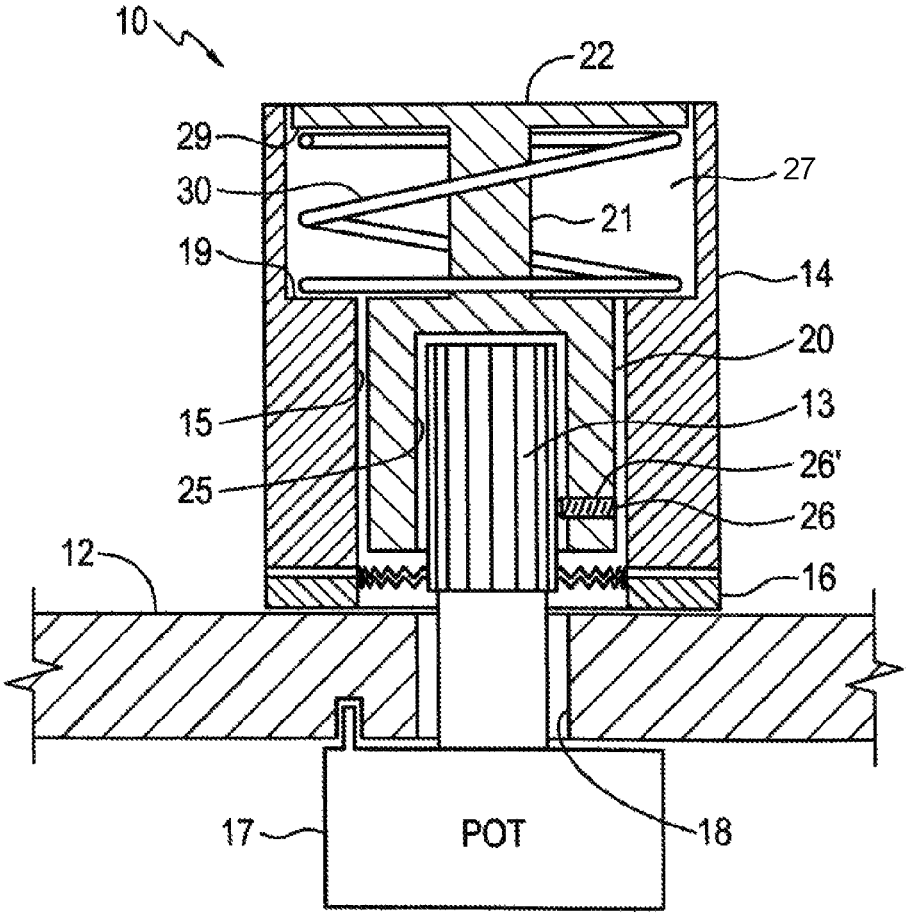
FIG. 4 is a cross-sectional elevational view taken along lines 4-4 of FIG. 3.

Hub 20 is generally comprised of a lower section which is shown surrounding shaft 13 in FIG. 4, and a T-shaped upper section 121 above that.

Figure 6:
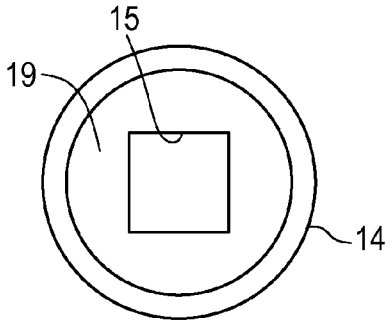
FIG. 6 is a top plan view of the outer barrel.
Figure 7:
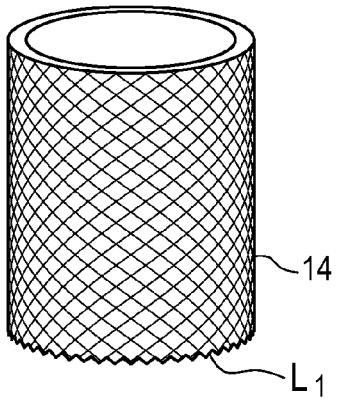
FIG. 7 is a top perspective view thereof.
Figure 8:
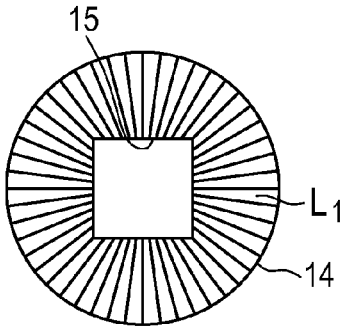
FIG. 8 is a bottom plan view thereof.
Figure 9:
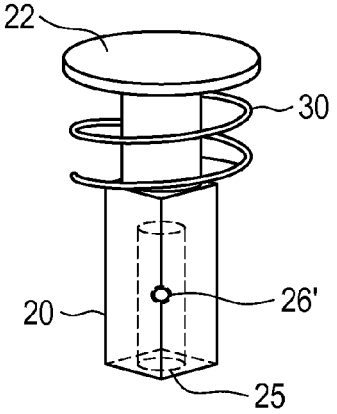
FIG. 9 is a top perspective view of the inner hub and biasing member of the invention showing a compression spring disposed thereon.
Figure 10:
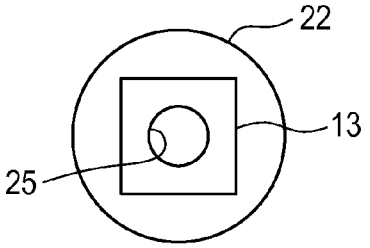
FIG. 10 is a bottom plan view thereof without the spring.
Figure 11:
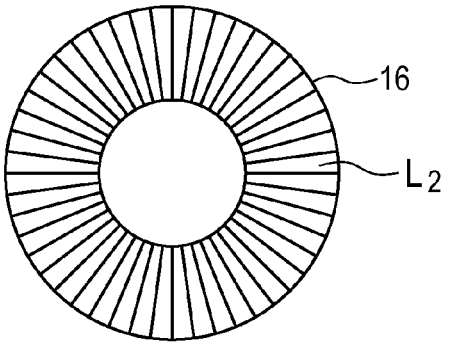
FIG. 11 is a top plan view of the locking ring.
Figure 12:
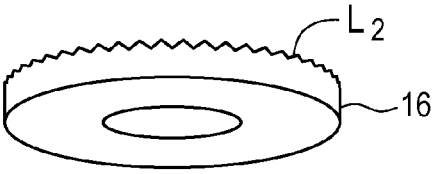
FIG. 12 is a bottom perspective view thereof.

In the embodiment shown, hub 20 has an integrally formed T-shaped head section 22, the underside thereof defining a shoulder 29. Opposite shoulder 29 is annular shoulder 19 defined by knob body 14. A compression spring 30 is disposed in the recess 27 formed between shoulder 19 and shoulder 29, and normally urges knob body 14 downwardly such that locking elements L1 and L2 engage each other, preventing rotation of knob body 14, hub 20 or output shaft 13 relative to object 12. Knob body 14 defines an inner bore 15 which preferably has a surface contour which substantially matches the surface contour of an outer surface of hub 20. In the embodiment shown, and as best seen in FIGS. 6 and 8, inner bore 15 and the outer surface of hub 20 are square shaped. It is, of course, to be appreciated that the surface contour of inner bore 25 and the outer surface of hub 20 may be of any shape, so long as angular movement therebetween is prevented while allowing axial (i.e. coaxial/parallel) movement therebetween.

From the foregoing, it is to be appreciated that exerting an upward force on knob body 14 strong enough to overcome the spring force of spring 30 will disengage locking elements $L_1$ and $L_2$ from one another, permitting rotation of knob body 14. This, in turn, due to the mating engagement of, or other connection between, the outer surface of hub 20 with bore 15, causes hub 20 to rotate, which, in turn, causes rotation of shaft 13, and consequent adjustment of control device 17.

Figure 3:
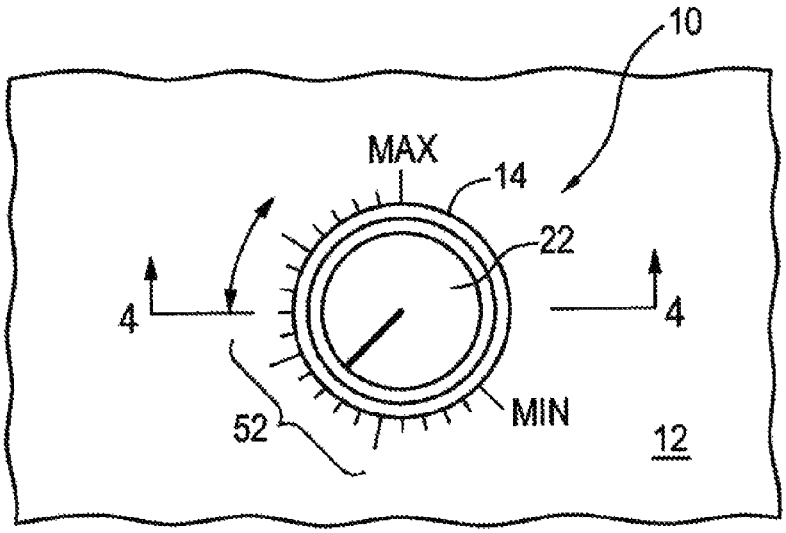
FIG. 3 is a top plan view of the embodiment of FIGS. 1 and 2.
Figure 5:
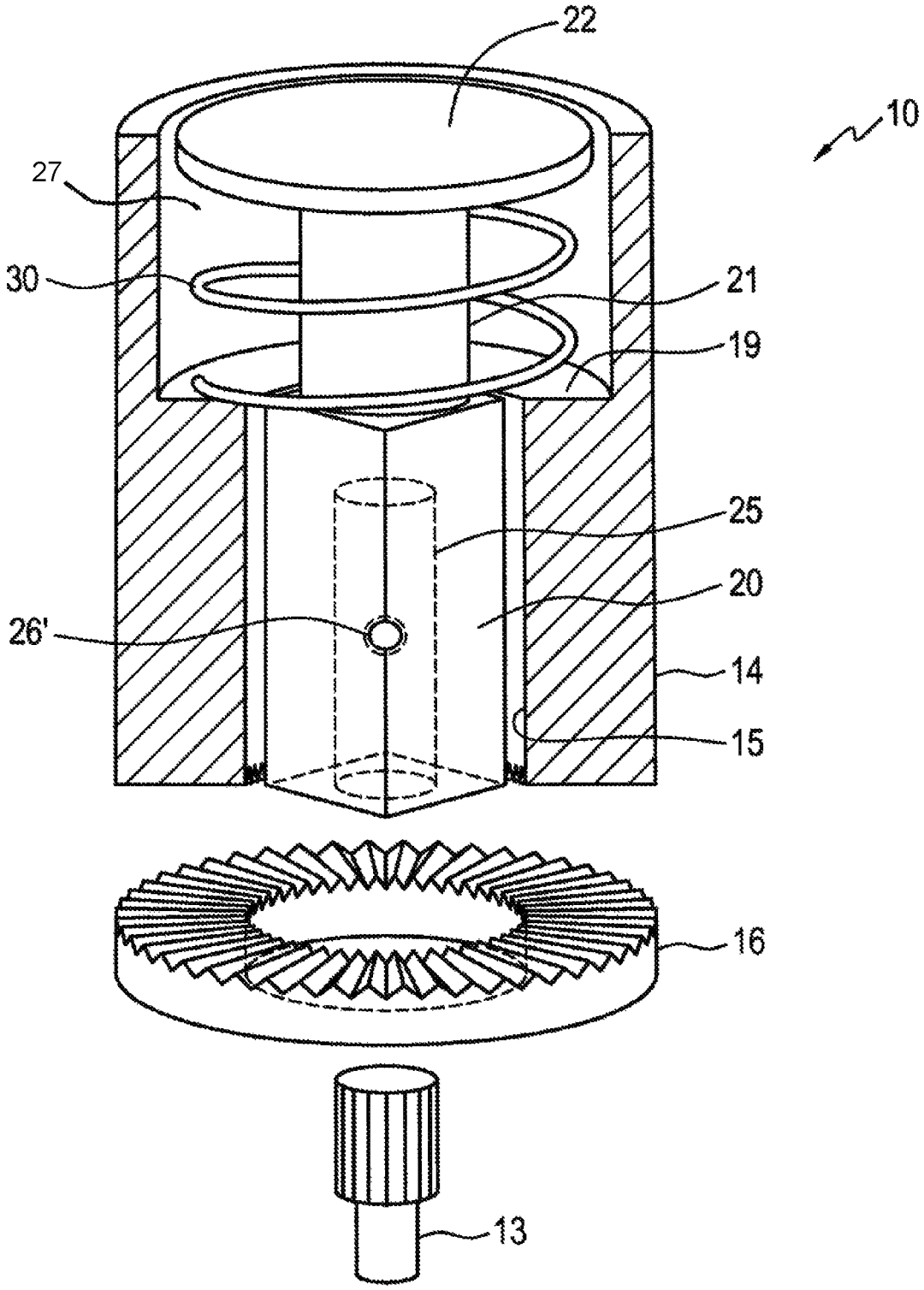
FIG. 5 is a partial cutaway exploded view of the first embodiment of the invention.

Indicia such as setting line 50 may be inscribed in head 22 (as shown in FIGS. 3 and 5) or the top or side circumferential surface of knob body 14, along with corresponding indicia 52 on object 12 (shown in FIG. 3). Upon rotation of knob body 14 relative to object 12, the angular position of setting line 50 relative to indicia 52 will change, indicating the adjustment position of the control device.

Figure 13:
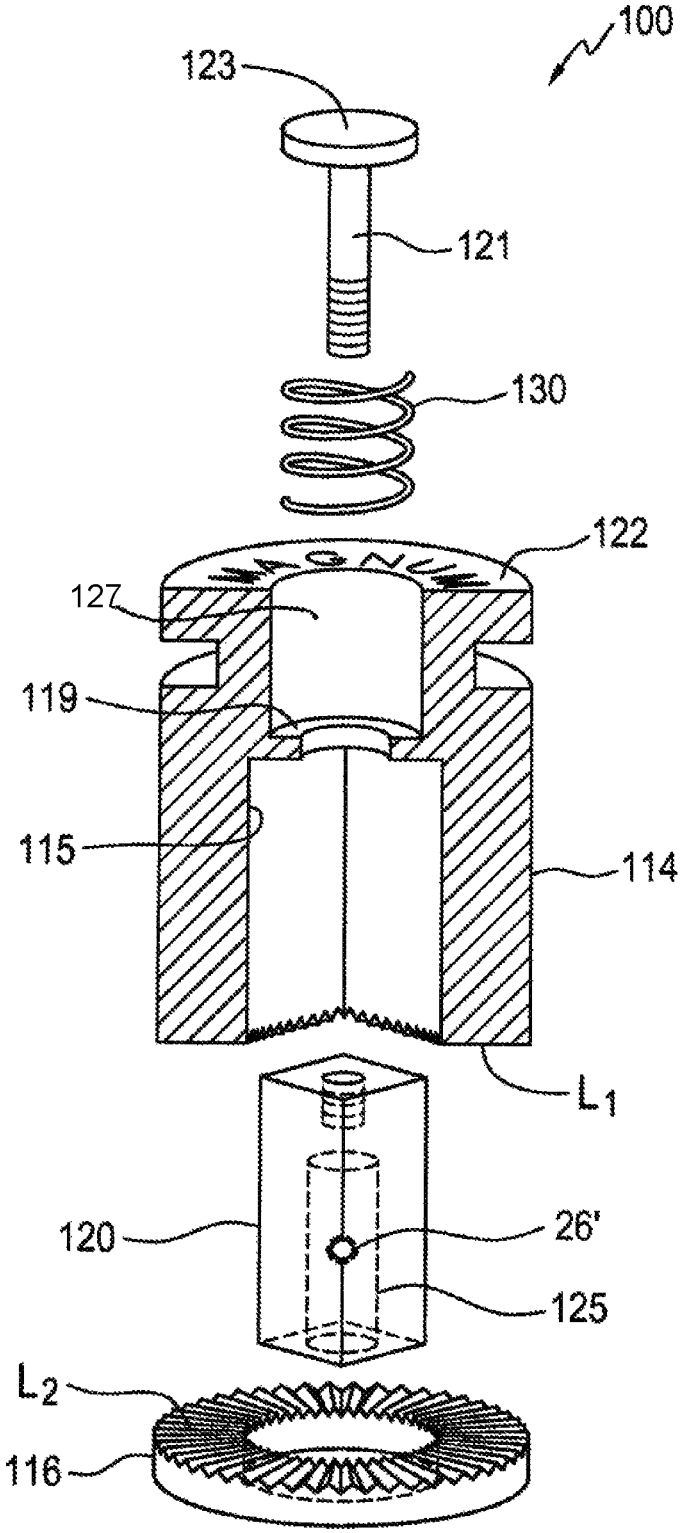
FIG. 13 is a top perspective partially cutaway view of a second embodiment of the invention.
Figure 14:
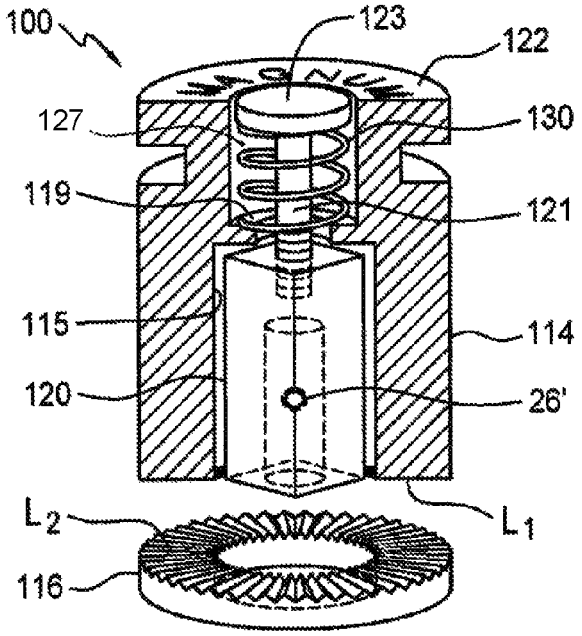
FIG. 14 is a bottom perspective view thereof.
Figure 15:
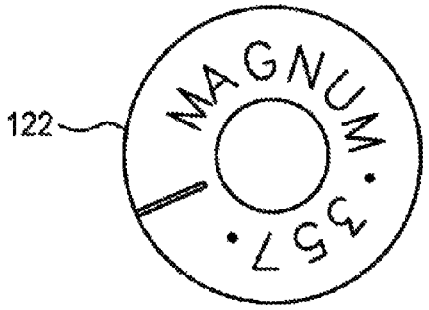
FIG. 15 is a top plan view of the knob of the second embodiment of this invention.

Referring now to FIGS. 13-15, a second embodiment of an adjustment knob is shown. In this embodiment, knob 100 is manufactured in the shape of an ornamental object, such as a bullet. It is to be understood, as stated previously, that the shape and ornamentation of the components of this invention may be varied to suit the circumstances. In this embodiment, knob 100 is comprised of an outer knob body 114 concentrically disposed about inner hub 120, which in turn is adapted to be concentrically disposed about shaft 13 of control device 17. A fastening means such as set screw 26 retained against shaft 13, or any other fastening means, is used to lock hub 120 in a given position relative to shaft 13, and to retain knob 100 in position relative to controller 17. Hub 120 defines an inner bore 125 which may, but need not necessarily, have a surface contour corresponding to the surface contour of shaft 13. The surface contour of shaft 13 may be cylindrical, splined, hexagonal, D-shaped, or any other suitable shape which prevents angular movement of hub 120 relative to output shaft 13. All that is required is that some means be provided for preventing angular movement of shaft 13 relative to hub 120, such as set screw 26 or providing an output shaft 13 with a polygonal surface (e.g. splined) which substantially matches that of the surface contour of journal 125 of hub 120.

Alternatively, for any embodiment of this invention, the contour of the exterior surface of shaft 13 of control device 17 need not match the surface contour of inner journal 25 or 125 of hubs 20, 120, because set screw 26 retains hubs 20, 120 in position relative to output shaft 13.

Knob body 114 defines an inner shoulder 119 against which a bottom end of spring 30 bears. Upper head 123 of shaft 121 defines a lower shoulder 129 against which the upper end of spring 30 bears, such that when knob body 114 is moved upwardly relative to hub 120, engagement elements $L_1$-$L_2$ become disengaged such barrel 114, hub 120 and shaft 13 can be rotated relative to object 12 and controller 17. Spring 30 urges knob body 114 back into a position where engagement elements $L_1$-$L_2$lock together, preventing adjustment of shaft 13.

Upper end 122 of barrel 114 may be designed to be coplanar with the top surface of head 123, or it may be of any other shape or orientation.

In order to make it easier to assemble/install the knob 100, the upper T-shaped section 121 of hub 120 is made to be releasably connectable to hub 120, as by threads 125. To assemble the knob 100, hub 120 is placed over shaft 13 and secured thereto, as by using set screw 26. Outer knob body 114 is then placed over hub 120, spring 30 placed into the recess 127 defined by knob body 114 above shoulder 119, and upper T-shaped section 121 screwed or otherwise connected to hub 120. This arrangement will lock knob body 114 into position about hub 120 and shaft 13, and, in an at-rest state such as that shown in FIG. 1, will cause locking elements $L_1$ and $L_2$ to engage. By pulling up on knob body 114 with a force sufficient to overcome the spring force of spring 30, locking elements $L_1$ and $L_2$ disengage from each other as shown in FIG. 14, so that one can rotatably adjust shaft 13. Releasing knob body 114 will allow spring 30 to urge knob body 114 downwardly such that locking elements $L_1$ and $L_2$ engage each other. It can be seen that head 123 generally resides in registry with opening 117 in the upper portion 122 of knob body 114.

Figure 17:
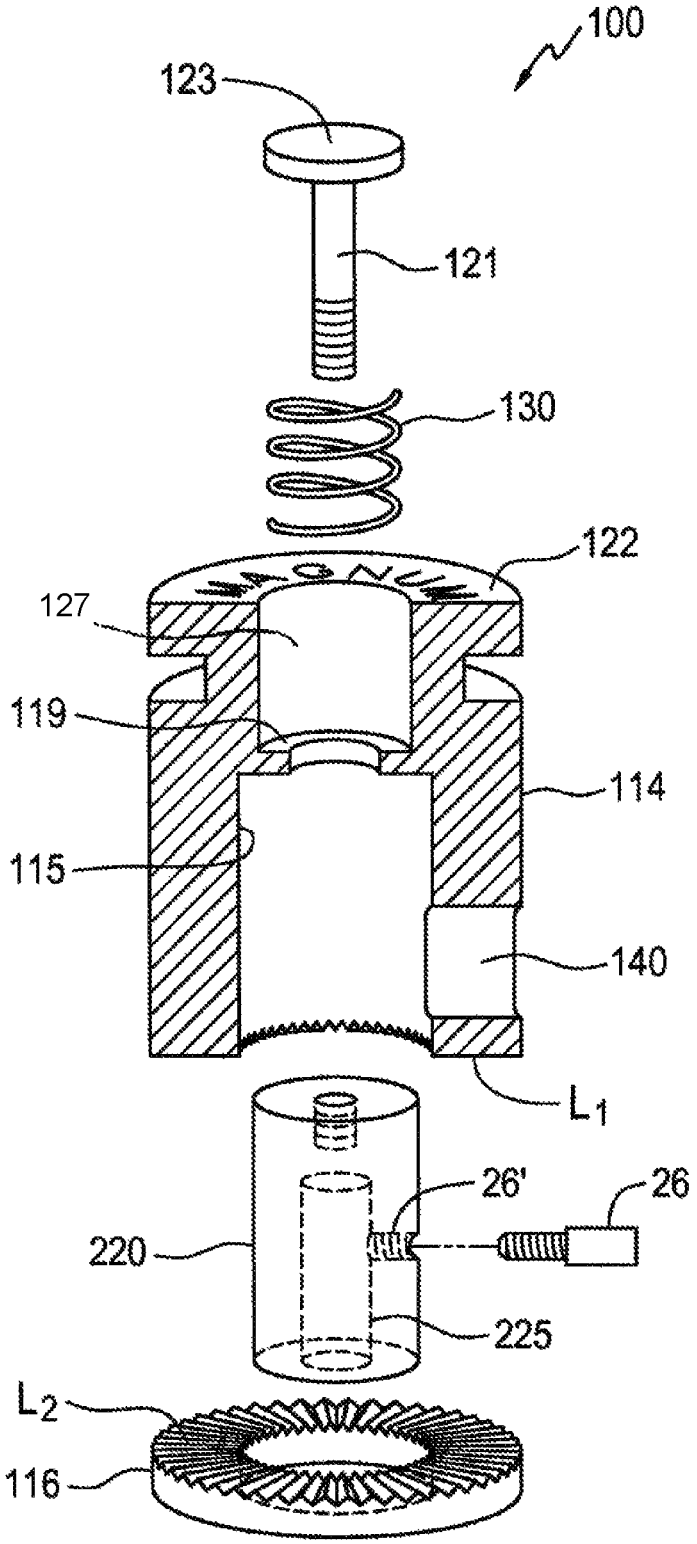
FIG. 17 is a top perspective partially cutaway view of a third embodiment of the invention.
Figure 18:
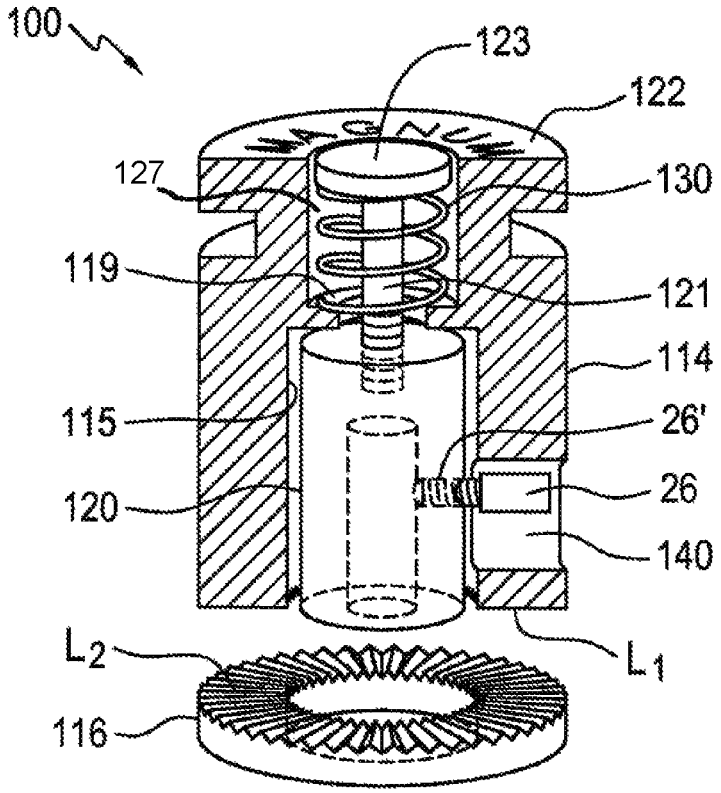
FIG. 18 is a bottom perspective view of thereof.

A modified version of the invention is shown in FIGS. 17-18, in which a radial slot 140 is placed in outer barrel 14 or 114 so that the set screw 26 or other fastening means may be accessed and installed or removed without the necessity of having to lift the outer barrel up to install the knob. This is particularly useful for smaller knob applications, such as for foot pedal controllers and the like.

In this embodiment, it is not necessary to have the outer surface of hub 220 and the inner surface of barrel 14 or 114 be polygonally shaped (e.g. square, splined, etc.) as in the embodiment of FIGS. 13-15, although such a configuration is neither obsoleted nor negated by this embodiment. However, if outer surface of hub 220 and the inner surface of barrel 14 or 114 are not polygonally shaped (e.g. square, splined, etc.) as in the embodiment of FIGS. 13-15, the set screw 26 should be of such a length that it protrudes into slot 140 when the knob is assembled, so that, when barrel 14 or 114 is rotated, set screw 26 will drive hub 220 to rotate as well so as to result in corresponding angular movement of shaft 13.

In one embodiment, the first locking element $L_1$ comprises teeth defined by a lower end of knob body 14, 114, and the second locking element $L_2$ comprises a locking member 16, 116 having corresponding teeth associated with the object 12. In another embodiment, the first and second locking elements $L_1$-$L_2$ comprise male and female hook and loop material instead of said teeth.

Benefits, other advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential feature or element of any or all the claims. The invention is defined solely by the appended claims including any amendments made during the pendency of this application and all equivalents of those claims as issued.

What is claimed:

1. A locking knob for use with a control device having an angularly adjustable shaft, the control device being connected to an object, comprising:

an inner hub defining an inner journal which is adapted to receive the shaft, said inner hub defining an inner radial bore;

an outer knob body concentrically disposed about at least a portion of the hub, the knob body defining an inner axial bore, an elongated radial slot and an open top, said inner radial bore of the hub being at least partially in registry with the radial slot of the knob body;

a set screw which releasably fastens the hub to the shaft, said set screw threadingly engaged in the inner radial bore and also extending non-threadingly into the radial slot and engaging one or more sidewalls of said slot when said knob body is rotated, to cause the inner hub to move in synchrony with the knob body in response to angular movement of the knob body;

the bore defined by the knob body at least partially defining an upwardly facing annular shoulder;

the hub comprised of an integrally formed T-shaped upper section in substantial registry with the open top of the knob body, the T-shaped upper section defining a downwardly facing annular shoulder at least a portion of which is disposed in opposed relationship to the upwardly facing annular shoulder of the knob body;

the knob body configured to move relative to the hub between a first, locked, position and a second, unlocked, position when the set screw is threadingly engaged in the inner radial bore to fasten the hub to the shaft and extended into the radial slot; and a biasing member compressively disposed between the annular shoulder of the knob body and the downward facing shoulder of the hub to bias the knob body into the locked position.

2. The dial of claim 1, wherein an upper section of the hub is threadingly connected to a lower section of the hub.

3. The locking knob of claim 1, further comprising:

a first plurality of locking teeth attached to a lower end of the knob body;

a second plurality of locking teeth attached to the object, the second plurality of locking teeth adapted to engage the first plurality of locking teeth in releasable locking engagement when the knob body is positioned in the first, locked, position.

4. The dial of claim 1, wherein the T-shaped upper section of the hub is threadingly connected to a lower section of the hub.

5. The locking knob of claim 1, wherein at least a portion of an outer surface of the hub is of polygonal cross-section, while the bore defined by the knob body has a corresponding polygonal cross-sectional configuration.

6. The locking knob of claim 5, wherein the cross-section of the outer surface of the hub is square, and the cross-sectional configuration of the bore defined by the knob body is square.

7. A locking knob for use with a control device having an angularly adjustable shaft, the control device being connected to an object, comprising:

an inner hub defining an inner journal which is adapted to receive the shaft, said inner hub defining an inner radial bore;

an outer knob body concentrically disposed about at least a portion of the hub, the knob body defining an inner axial bore, an elongated radial slot and an open top, said inner radial bore of the hub being at least partially in registry with the radial slot of the knob body;

a set screw which releasably fastens the hub to the shaft, at least a portion of the set screw being in substantial registry with the radial slot, said set screw extending non-threadingly into the radial slot and engaging one or more sidewalls of said slot when said knob body is rotated, to cause the inner hub to move in synchrony with the knob body in response to angular movement of the knob body;

the bore defined by the knob body at least partially defining an upwardly facing annular shoulder;

the hub comprised of an integrally formed T-shaped upper section in substantial registry with the open top of the knob body, the T-shaped upper section defining a downwardly facing annular shoulder at least a portion of which is disposed in opposed relationship to the upwardly facing annular shoulder of the knob body;

the knob body axially configured to move relative to the hub between a first, locked, position, and a second, adjustment, position when the set screw is threadingly engaged in the inner radial bore to fasten the hub to the shaft and extended into the radial slot; and a biasing member compressively disposed between the annular shoulder of the knob body and the downward facing shoulder of the hub to bias the knob body into the locked position.

8. The locking knob of claim 7, further comprising:

a first plurality of locking teeth attached to a lower end of the knob body;

a second plurality of locking teeth attached to the object, the second plurality of locking teeth adapted to engage the first plurality of locking teeth in releasable locking engagement when the knob body is positioned in the first, locked, position.

9. The locking knob of claim 7, wherein at least a portion of an outer surface of the hub is of polygonal cross-section, while the bore defined by the knob body has a corresponding polygonal cross-sectional configuration.

10. The locking knob of claim 7, wherein the cross-section of the outer surface of the hub is square, and the cross-sectional configuration of the bore defined by the knob body is square.

* * * * *